US009966080B2

(12) United States Patent
Koppens et al.

(10) Patent No.: US 9,966,080 B2
(45) Date of Patent: May 8, 2018

(54) AUDIO OBJECT ENCODING AND DECODING

(71) Applicant: KONINKLIJKE PHILIPS N.V., Eindhoven (NL)

(72) Inventors: Jeroen Gerardus Henricus Koppens, Nederweert (NL); Arnoldus Werner Johannes Oomen, Eindhoven (NL); Leon Maria Van De Kerkhof, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 14/350,112

(22) PCT Filed: Oct. 29, 2012

(86) PCT No.: PCT/IB2012/055964
§ 371 (c)(1),
(2) Date: Apr. 7, 2014

(87) PCT Pub. No.: WO2013/064957
PCT Pub. Date: May 10, 2013

(65) Prior Publication Data

US 2014/0297296 A1 Oct. 2, 2014

Related U.S. Application Data

(60) Provisional application No. 61/554,007, filed on Nov. 1, 2011.

(51) Int. Cl.
*G10L 19/008* (2013.01)

(52) U.S. Cl.
CPC ..... *G10L 19/008* (2013.01)

(58) Field of Classification Search
CPC combination set(s) only.
See application file for complete search history.

(56) References Cited

U.S. PATENT DOCUMENTS

2007/0258607 A1* 11/2007 Purnhagen ..... G10L 19/008 381/307
2008/0008323 A1* 1/2008 Hilpert ..... G10L 19/008 381/1

(Continued)

FOREIGN PATENT DOCUMENTS

CN 1930608 A 3/2007
WO 2008039038 A1 4/2008

(Continued)

OTHER PUBLICATIONS

Anonymous, "ISO/IEC FDIS 203003-2: 2010, Spatial Audio Object Coding", MPEG Meeting, No. N11207, May 10, 2010, XP030017704.

(Continued)

*Primary Examiner* — Keara Harris

(57) ABSTRACT

An audio object encoder comprises a receiver (701) which receives N audio objects. A downmixer (703) downmixes the N audio objects to M audio channels, and a channel circuit (707) derives K audio channels from the M audio channels, K=1, 2 and K<M. A parameter circuit (709) generates audio object upmix parameters for at least part of each of the N audio objects relative to the K audio channels and an output circuit (705, 711) generates an output data stream comprising the audio object upmix parameters and the M audio channels. An audio object decoder receives the data stream and includes a channel circuit (805) deriving K audio channels from the M channel downmix; and an object decoder (807) for generating at least part of each of the N audio objects by upmixing the K audio channels based on the audio object upmix parameters. The invention may allow improved object encoding while maintaining backwards compatibility.

16 Claims, 12 Drawing Sheets

(56) References Cited

U.S. PATENT DOCUMENTS

| | | | | |
|---|---|---|---|---|
| 2009/0125314 | A1 | 5/2009 | Hellmuth et al. | |
| 2010/0114582 | A1 | 5/2010 | Beack et al. | |
| 2010/0324915 | A1 | 12/2010 | Seo et al. | |
| 2011/0022402 | A1* | 1/2011 | Engdegard et al. | 704/501 |
| 2016/0203823 | A1 | 7/2016 | Purnhagen et al. | |

FOREIGN PATENT DOCUMENTS

| | | | |
|---|---|---|---|
| WO | 2008046530 | A2 | 4/2008 |
| WO | 2008046531 | A1 | 4/2008 |
| WO | 2011039195 | A1 | 4/2011 |

OTHER PUBLICATIONS

Hellmuth et al, MPEG Spatial Audio Object Coding—The ISO/MPEG Stardard for Efficient Coding of Interactive Audio, AES Convention, 2010, pp. 1-19.

Anonymous, "Multichannel Stereophonic Sound System With and Without Accompanying Picture", Recommendation ITU-R BS.775-2, 2006, 13 Page Document.

Anonymous, "Inoformation Technology—MPEG Audio Technologies—Part 1: MPEG Surround", ISO/IEC FDIS 23003-1, 2006, 289 Page Document.

* cited by examiner

AUDIO OBJECT ENCODING AND DECODING

CROSS-REFERENCE TO PRIOR APPLICATIONS

This application is the U.S. National Phase application under 35 U.S.C. § 371 of International Application No. PCT/IB2012/055964, filed on Oct. 29, 2012, which claims the benefit of U.S. Provisional Application No. 61/554,007, filed on Nov. 1, 2011. These applications are hereby incorporated by reference herein.

FIELD OF THE INVENTION

The invention relates to audio object encoding and decoding and in particular, but not exclusively, to audio object encoding and/or decoding compatible with the MPEG SAOC (Spatial Audio Object Coding) standard.

BACKGROUND OF THE INVENTION

Multichannel audio is widespread and has become popular for many different applications including home cinema and multi-channel music systems. Audio encoding is often used to generate data streams that provide an efficient data representation of the audio signals. Such audio encoding allows an efficient storage and distribution of audio signals. Many different audio encoding standards have been developed for encoding and decoding of both traditional mono and stereo audio signals, as well as for encoding and decoding of multichannel audio signals. The term multichannel is henceforth used to refer to more than two channels. The use of dedicated audio standards allows for interworking and compatibility between many different systems, devices and applications, and it is therefore critical that efficient standards are adhered to. However, a significant problem arises when new standards are developed or existing standards are modified. In particular, modifications to standards may not only be time consuming and cumbersome to carry out but may also result in existing equipment not being suitable for the new or indeed for the existing standards. In order to facilitate introduction of new standards or standard modifications, it is desirable that these require as little modification to existing standards as possible. In some cases it is even possible to make modifications that are fully compatible with the existing standards, i.e. the modifications can be applied without any change to the existing standard specification. An example of this is bitstream watermarking. In bitstream watermarking specific bitstream elements are modified in a compatible fashion such that the bitstream can still be decoded according to the standard specification. Although the output has changed, the difference in quality is generally not audible.

MPEG Surround is one of the major advances in multichannel audio coding and was recently standardized by Motion Picture Experts Group in ISO/IEC 23003-1. MPEG Surround is a multi-channel audio coding tool that allows existing mono- or stereo-based services to be extended to multi-channel applications. FIG. 1 shows a block diagram of a stereo core coder extended with MPEG Surround. First the MPEG Surround encoder creates a stereo downmix from the multi-channel input signal. Next, spatial parameters are estimated from the multi-channel input signal. These parameters are encoded into the MPEG Surround bit-stream. The stereo downmix is coded into a bit-stream using a core encoder, e.g. HE-AAC. The resulting core coder bit-stream and the spatial bit-stream are merged to create the overall bit-stream. Typically the spatial bit-stream is contained in the ancillary data or user data portion of the core coder bit-stream. At the decoder side the core and spatial bit-stream are separated. The stereo core bit-stream is decoded in order to reproduce the stereo downmix. This downmix together with the spatial bit-stream is input to the MPEG Surround decoder. The spatial bit-stream is decoded to provide the spatial parameters. The spatial parameters are then used to upmix the stereo downmix in order to obtain the multi-channel output signal.

Since the spatial image of the multi-channel input signal is parameterized, MPEG Surround allows for decoding of the same multi-channel bit-stream onto rendering devices other than a multichannel speaker setup. An example is virtual surround reproduction on headphones, which is referred to as the MPEG Surround binaural decoding process. In this mode, a realistic surround experience can be provided using regular headphones. FIG. 2 shows a block diagram of the stereo core codec extended with MPEG Surround where the output is decoded to binaural. The encoder process is identical to that of FIG. 1. In the system, the spatial parameters are combined with the Head Related Transfer Function (HRTF) and the result is used to produce the so-called binaural output.

Building upon the concept of MPEG Surround, MPEG has standardized a system for encoding of individual audio objects. This standard is known as 'Spatial Audio Object Coding' (MPEG-D SAOC) ISO/IEC 23003-2. From a high level perspective, SAOC efficiently encodes sound objects instead of audio channels where each sound object may typically correspond to a single sound source in the sound image. In MPEG Surround, each speaker channel can be considered to originate from a different mix of sound objects whereas in SAOC data is provided for the individual sound objects. Similarly to MPEG Surround, a mono or stereo downmix is also created in SAOC. Specifically, SAOC also generates a mono or stereo downmix which is coded using a standard downmix coder such as HE-AAC. In this way, legacy playback devices will disregard the parametric data and play the mono or stereo downmix whereas SAOC decoders can upmix the signal to retrieve the original sound objects or to allow them to be rendered in a desired output configuration. Object and downmix parameters are embedded in the ancillary data portion of the downmix coded bitstream to provide relative level and gain information for the individual SAOC objects, typically reflecting the downmix of these into the stereo/mono downmix. At the decoder side, the user can control various features of the individual objects (such as spatial position, amplification, and equalization) by manipulating these parameters, or the user can apply effects, such as reverb, to individual objects.

FIG. 3 shows a block-diagram for regular SAOC encoding. The SAOC encoder can be considered to be a preprocessing module situated before a conventional mono- or stereo encoder. The preprocessing consists of generating a stereo (or mono) downmix from a number N of object signals. Additionally object parameters are extracted and stored in an SAOC bitstream together with information on the downmix matrix M. The SAOC downmix information is encoded in two types of parameters. First the DMG (downmix gain) parameter indicates the gain applied to the object. The DCLD (downmix channel level difference) parameter signals the distribution of the object over the two channels in a stereo downmix. These parameters are both defined per object.

A SAOC decoder may perform the opposite operation. The received mono- or stereo downmix may be decoded and upmixed to a desired output configuration. The upmix operation includes the combined operation of an upmixing of the mono- or stereo downmix to generate the audio objects followed by a mapping of these to the desired output configuration based on a rendering matrix as illustrated in FIG. 4, where the mono or stereo input downmix is first upmixed to N audio objects based on the SAOC parameters. The resulting N audio objects are then downmixed to P output channels using a rendering matrix defining where the individual objects are positioned. FIG. 4 illustrates the conceptual SAOC decoding. However, typically the upmix matrix and the rendering matrix are combined into a single matrix and the generation of the output channels from the mono- or stereo downmix is performed as a single operation. An example thereof is shown in FIG. 5 which shows a specific example wherein P equals one or two, and where specifically for P=2 the output may be a binaural spatial output channel. Thus, the two output channels are generated using HRTF parameters applied to the individual objects to generate the desired binaural spatial image. FIG. 9 illustrates an example where P>2 and an MPEG Surround (MPS) decoding/processing is used to generate the P output channels.

However, an issue associated with SAOC is that the specification only supports mono- and stereo downmixes whereas there are a number of applications and use-cases in which multi-channel mixes are used or even sometimes required, for instance DVD and Blu-Ray. It would therefore be desirable for SAOC to support such multi-channel applications, i.e. a multichannel downmix, but this would require substantial amendments to the SAOC standard specification which would be cumbersome, impractical, increase complexity and result in reduced backwards compatibility.

In particular, it would be advantageous if existing algorithms, functional units, dedicated hardware etc. developed for SAOC encoding and decoding could be reused while allowing improved support for multichannel audio.

Hence, an improved approach for object encoding and/or decoding (such as e.g. SAOC encoding/decoding) would be advantageous and in particular approaches allowing increased flexibility, reduced impact on standardised approaches, increased or facilitated backwards compatibility, allowing increased reuse of encoding and/or decoding functionality, facilitated implementation, multichannel support in object encoding, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio object encoder comprising: a receiver for receiving N audio objects; a mixer for mixing the N audio objects to M audio channels; a channel circuit for deriving K audio channels from the M audio channels where K=1 or 2 and K<M; a parameter circuit generating audio object upmix parameters for at least part of each of the N audio objects relative to the K audio channels; an output circuit for generating an output data stream comprising the audio object upmix parameters and the M audio channels.

The invention may allow audio encoding that can provide improved performance for multichannel rendering systems while supporting audio object encoding. The system may in some scenarios allow improved multichannel rendering and may in some scenarios allow improved audio object functionality. A low data rate can be achieved by combining M audio channels with audio object upmix parameters relating to K audio channels such that it is not necessary to include encoded data for the K audio channels in the output data stream.

The invention may allow multichannel support (with more than two channels) in audio object encoding systems providing audio object encoding (and/or decoding) based on only mono and stereo signals. The encoding may generate an output data stream wherein a multichannel signal is provided together with associated audio object data, which however is not defined relative to the multichannel signal but rather relative to a mono or stereo signal that can be derived from the multichannel signal.

The invention may in many applications allow improved reuse and/or backwards compatibility with existing audio object encoding and/or decoding functionality.

An audio object may be an audio signal component corresponding to a single sound source in the audio environment. Specifically, the audio object may include audio from only one position in the audio environment. An audio object may have an associated position but not be associated with any specific rendering sound source configuration, and may specifically not be associated with any specific loudspeaker configuration.

The output data stream may not include any encoding data of the K audio channels. In some embodiments, all of one, more or all of the N audio objects is generated from the K audio channels.

The derivation of the K channels may be performed in each segment, and the specific derivation may change dynamically, e.g. between segments. In many embodiments and/or scenarios M may be smaller than N.

In accordance with an optional feature of the invention, the channel circuit is arranged to derive the K channels by downmixing the M audio channels.

This may provide a particularly advantageous system in many scenarios and applications. Particularly, it may allow reuse of functionality and may allow efficient audio object encoding and decoding. Specifically, the approach may allow the generated downmix to provide suitable components in the K audio channels for all audio objects also represented in the M audio channels.

In some embodiments, the downmixing may be such that each of the M audio channels is represented in at least one of the K channels, and in some embodiments in all of the K channels.

In accordance with an optional feature of the invention, the channel circuit is arranged to derive the K channels by selecting a K channel subset of the M audio channels.

This may provide a particularly advantageous system in many scenarios and applications. Particularly, it may allow reuse of functionality and may allow efficient audio object encoding and decoding. In many embodiments it may reduce complexity and/or increase flexibility. The selection of K channels may be dynamically varied allowing different K channels to be selected in different time segments.

In accordance with an optional feature of the invention, the output data stream comprises a multichannel encoded data stream for the M audio channels, and the audio object upmix parameters are comprised in a part of the multichannel encoded data stream.

This may provide a particularly advantageous output data stream in many embodiments. In particular, it may allow a combined data stream which supports both multichannel audio directly and audio object encoding based on mono and/or stereo signals thereby allowing backwards compatibility. Thus a multichannel encoded data stream may be provided which contains the multichannel signal and audio object upmix parameters which are not provided relative to the encoded multichannel signal yet which still allows the object decoding based on the encoded multichannel signal.

In accordance with an optional feature of the invention, the output circuit is arranged to include mixing data representative of the mixing of the N audio objects to the M audio channels in the output data stream.

This may allow improved performance in many embodiments, and may in particular in many embodiments allow improved audio object decoding and functionality to be provided at the decoder. The mix data may e.g. be defined in the time frequency domain.

In accordance with an aspect of the invention, there is an audio object decoder comprising: a receiver for receiving a data stream comprising audio data for an M channel mix of N audio objects and audio object mix parameters for the N audio objects relative to K audio channels where K=1 or 2 and K<M; a channel circuit deriving K audio channels from the M channel mix; and an object decoder for generating P audio signals from N audio objects at least partially generated by upmixing the K audio channels based on the audio object upmix parameters.

The invention may allow for audio object decoding and may in particular allow efficient audio object decoding based on a signal that directly supports multichannel rendering systems. The audio object decoder may generate the P audio signals without any audio encoding data being received for the K audio channels.

The invention may in many applications allow improved reuse and/or backwards compatibility with existing audio object encoding and/or decoding functionality.

The object decoder may be arranged to generate the P audio signals by upmixing the K channels to N audio objects and then mapping the N audio objects to the P audio channels. The mapping may be represented by a rendering matrix. The upmixing of the K channels to the N audio objects and the mapping of the N audio objects to the P output channels may be performed as a single integrated operation. Specifically, a KtoN upmix matrix may be combined with an NtoP matrix to generate a KtoP matrix which is directly applied to the K channels to generate the P output signals. Thus, the object decoder may be arranged to generate P output channels based on the audio object upmix parameters for the N audio objects and a rendering matrix for the P output channels. In some embodiments, the N audio objects may be explicitly generated, and especially each of the P audio signals may correspond to a single audio object of the N audio objects. In some scenarios N may be equal to P.

In accordance with an optional feature of the invention, the channel circuit is arranged to derive the K channels by downmixing the M audio channels.

This may provide a particularly advantageous system in many scenarios and applications. Particularly, it may allow efficient audio object encoding and decoding. Specifically, the approach may allow the generated downmix to provide suitable components in the K audio channels for all audio objects also represented in the M audio channels. In some embodiments, the object decoder may be arranged to generate each of N audio objects by upmixing the K audio channels based on the audio object upmix parameters.

In some embodiments, the downmixing may be such that each of the M audio channels is represented in at least one of the K channels, and in some embodiments in all of the K channels.

In accordance with an optional feature of the invention, the data stream further comprises downmix data indicative of an encoder downmixing from M to K channels, and wherein the channel circuit is arranged to adapt the downmixing in response to the downmix data.

This may allow increased flexibility and/or improved performance in many embodiments. For example, it may allow adaptation of the downmix to the specific signal characteristics and may e.g. allow the downmix to be adapted to the N audio objects to provide suitable signal components of all N audio objects to allow the generation in the decoder of the objects.

In some embodiments, a fixed or predetermined downmix from M channels to K channels may be used in the encoder and the decoder. This may reduce complexity and may specifically obviate the need to include data indicative of the downmix in the data stream, thereby potentially allowing a reduced data rate.

In accordance with an optional feature of the invention, the channel circuit is arranged to derive the K channels by selecting a K channel subset of the M audio channels.

This may allow improved and/or facilitated audio object encoding in many embodiments. It may in many embodiments allow reduced complexity.

In accordance with an optional feature of the invention, the data stream further comprises additional audio object upmix parameters for the N audio objects relative to L audio channels where L=1 or 2 and L<M, and the L audio channels and the K audio channels are different subsets of the M audio channels, and wherein the object decoder is further arranged to generate the P channels from N audio objects at least partially generated by upmixing the L audio channels based on the additional audio object upmix parameters.

This may allow improved audio object decoding in many embodiments. In particular it may allow the signal components of each audio object in more than K (and in particular all M) audio channels to be used in generating the audio object.

The subsets may be disjoint. In some embodiments, further upmixing may be based on one or more additional subsets of audio channels with associated audio object upmix parameters. In some embodiments, the combination of subsets may include all M audio channels.

In accordance with an optional feature of the invention, at least one of the P channels is generated by combining contributions from both the upmixing of the K audio channels based on the audio object upmix parameters and the upmixing of the L audio channels based on the additional audio object upmix parameters.

This may allow improved audio object decoding in many embodiments. In particular it may allow the signal components of each audio object in more than K (and in particular all M) audio channels to be used in generating the audio object.

In accordance with an optional feature of the invention, the data stream comprises mix data representative of the mixing of the N audio objects to the M audio channels, and wherein the object decoder is arranged to generate residual data for at least a subset of the N audio objects in response to the mix data and the audio object upmix parameters, and to generate the P audio signals in response to the residual data.

This may provide improved quality of one, some or all of the decoded audio objects in many embodiments. In many embodiments it may allow compatibility with standardized audio object decoding algorithms capable of receiving residual data, such as for example the SAOC standard. The residual data may specifically be indicative of a difference between an audio object generated from the K channels and the audio object upmix parameters, and the corresponding audio object generated on the basis of the M audio channels and the downmix data.

In accordance with an aspect of the invention, there is provided a method of audio object encoding comprising: receiving N audio objects; mixing the N audio objects to M audio channels; deriving K audio channels from the M audio channels where K=1 or 2 and K<M; generating audio object upmix parameters for at least part of each of the N audio objects relative to the K audio channels; and generating an output data stream comprising the audio object upmix parameters and the M audio channels.

In accordance with an optional feature of the invention, there is provided a method of audio object decoding comprising: receiving a data stream comprising audio data for an M channel mix of N audio objects and audio object upmix parameters for the N audio objects relative to K audio channels where K=1 or 2 and K<M; deriving K audio channels from the M channel mix; and generating P audio signals from N audio objects at least partially generated by upmixing the K audio channels based on the audio object upmix parameters.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on an object encoder and decoder system wherein N audio objects are downmixed to M audio channels, i.e. wherein M<N. However, it will be appreciated that other mixes may be used and that M may in some embodiments and scenarios be equal to or larger than N.

Figure 1:
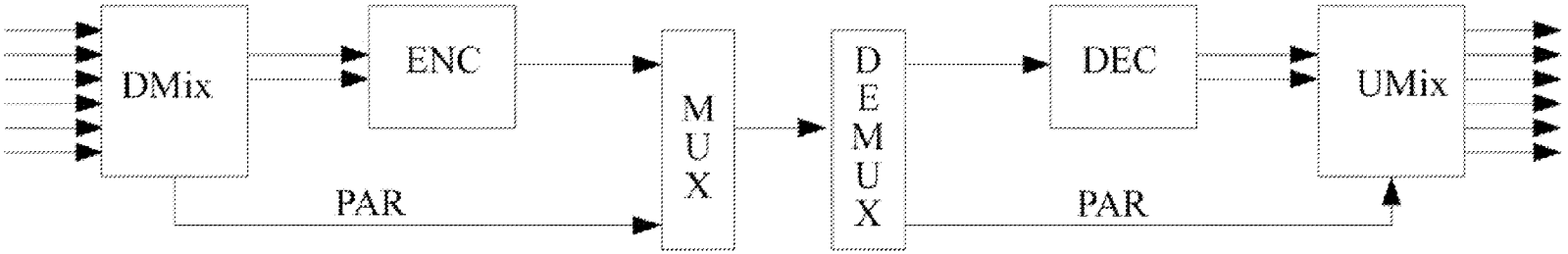
FIG. 1 Prior Art
FIG. 1 is an illustration of an MPEG Surround system in accordance with prior art.
Figure 2:
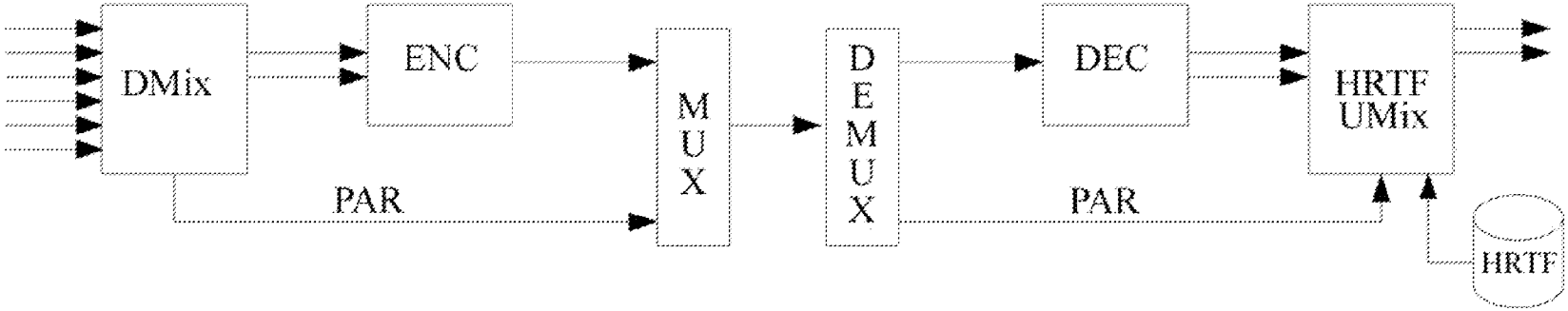
Prior Art FIG. 2
FIG. 2 is an illustration of an MPEG Binaural Surround system in accordance with prior art.
Figure 3:
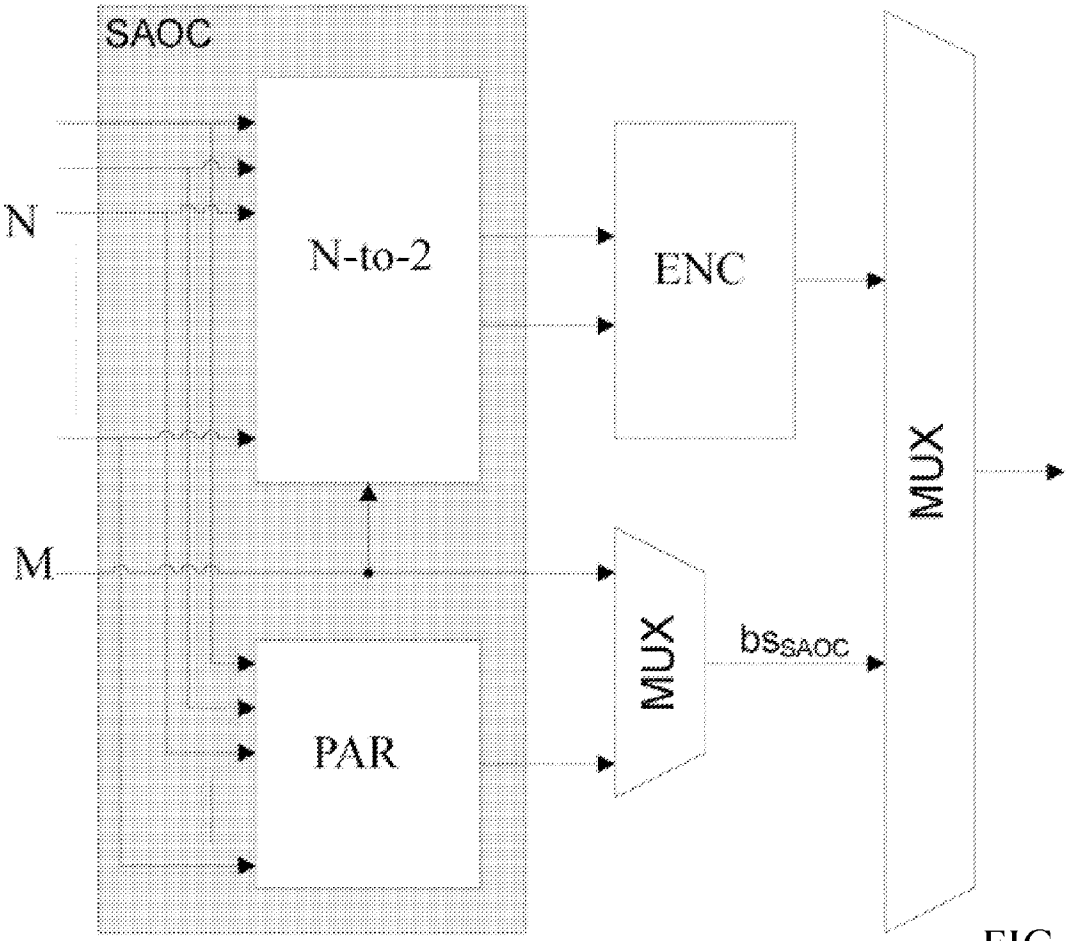
FIG. 3 Prior Art
FIG. 3 is an illustration of an MPEG SAOC encoder in accordance with prior art.
Figure 4:
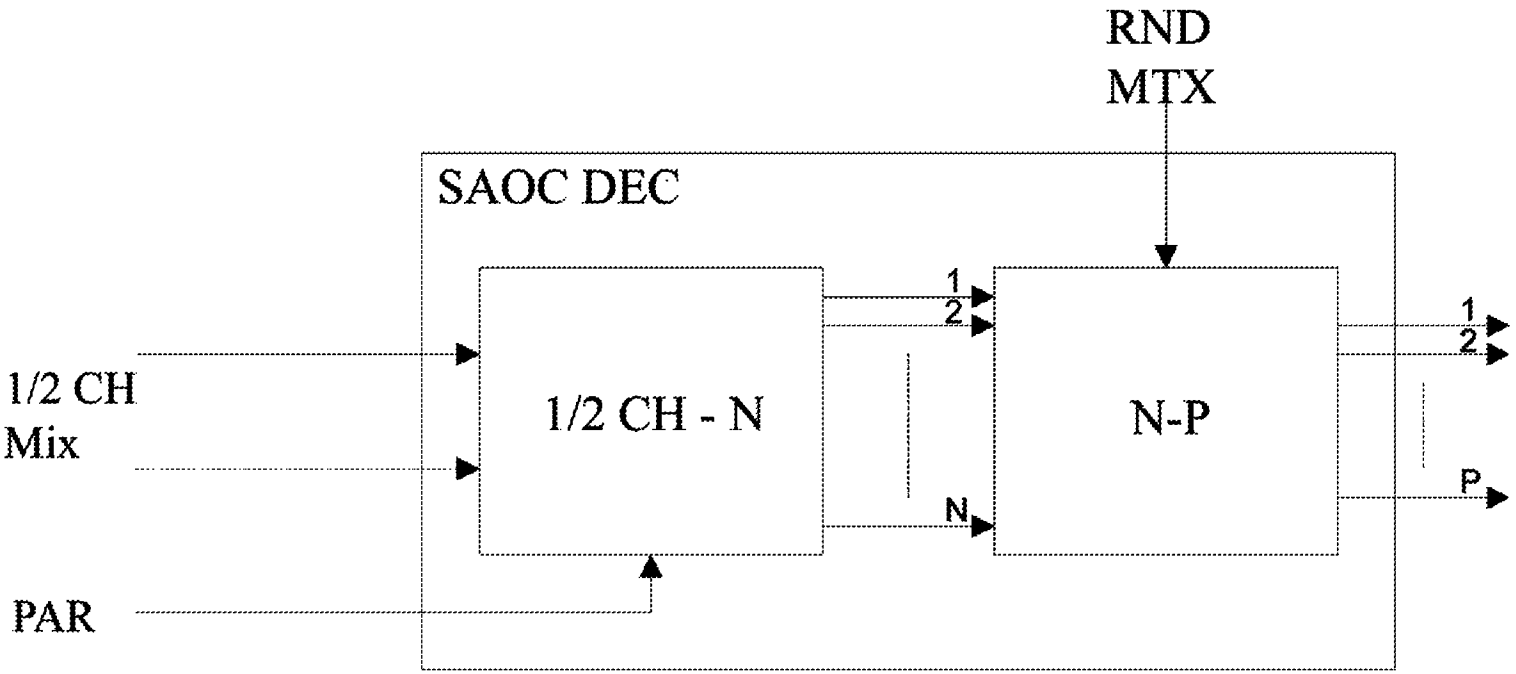
FIG. 4-6 illustrate examples of MPEG SAOC decoders in accordance with prior art.
Figure 5:
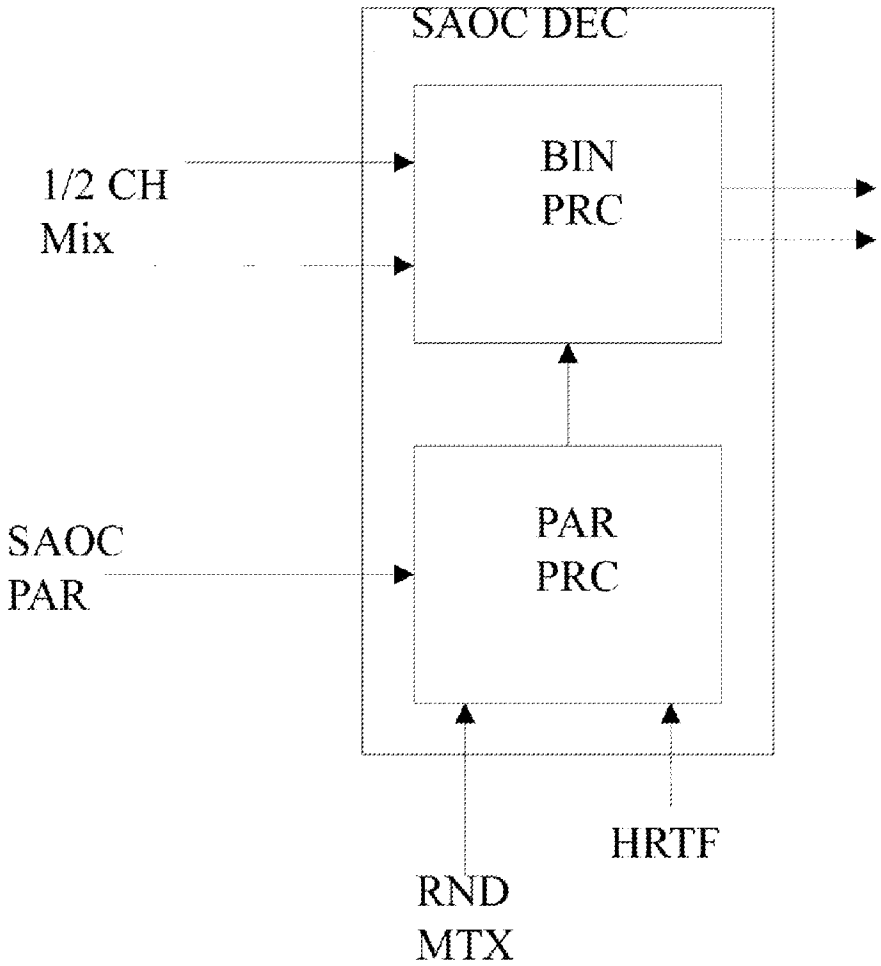
Figure 6:
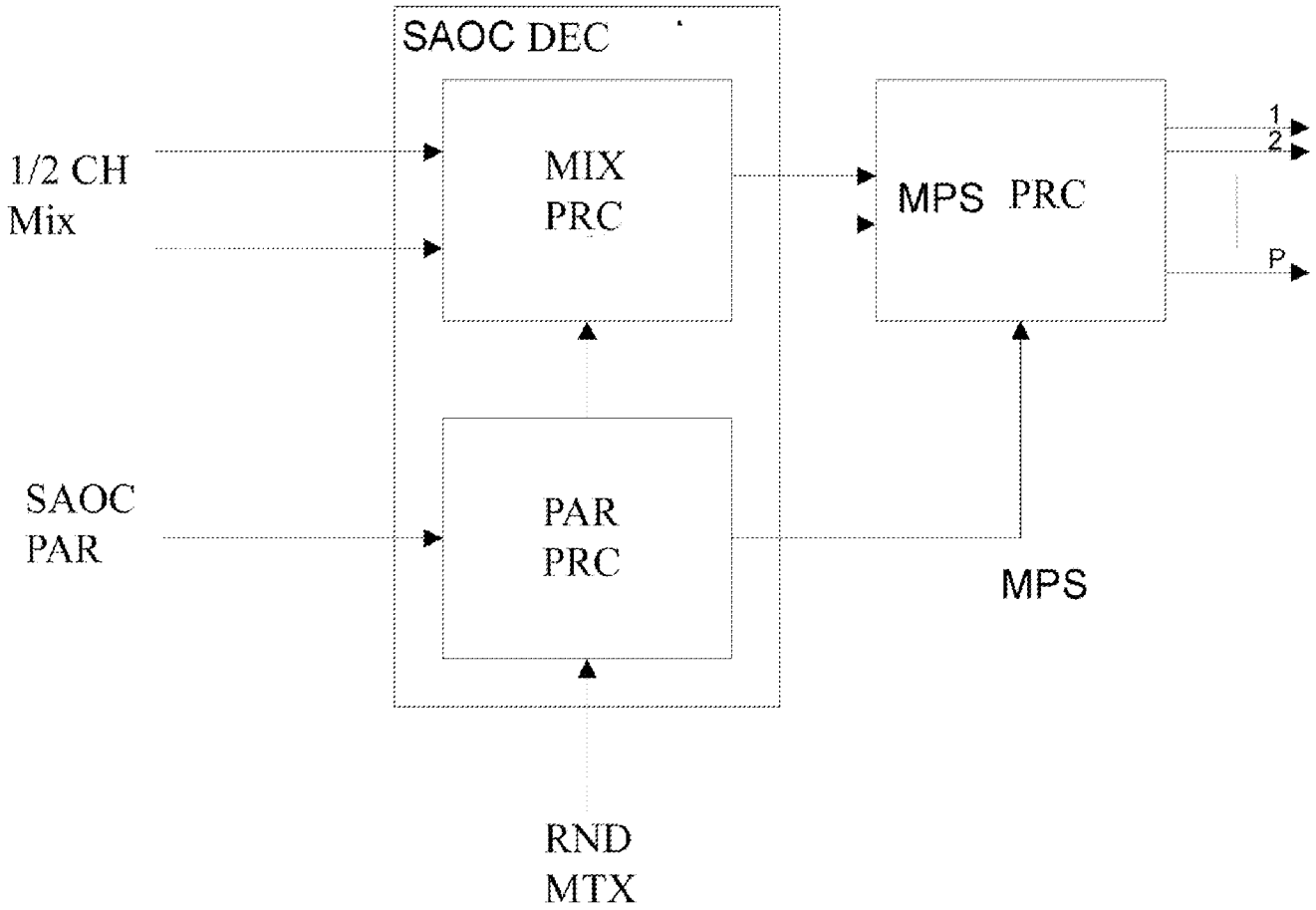
Figure 7:
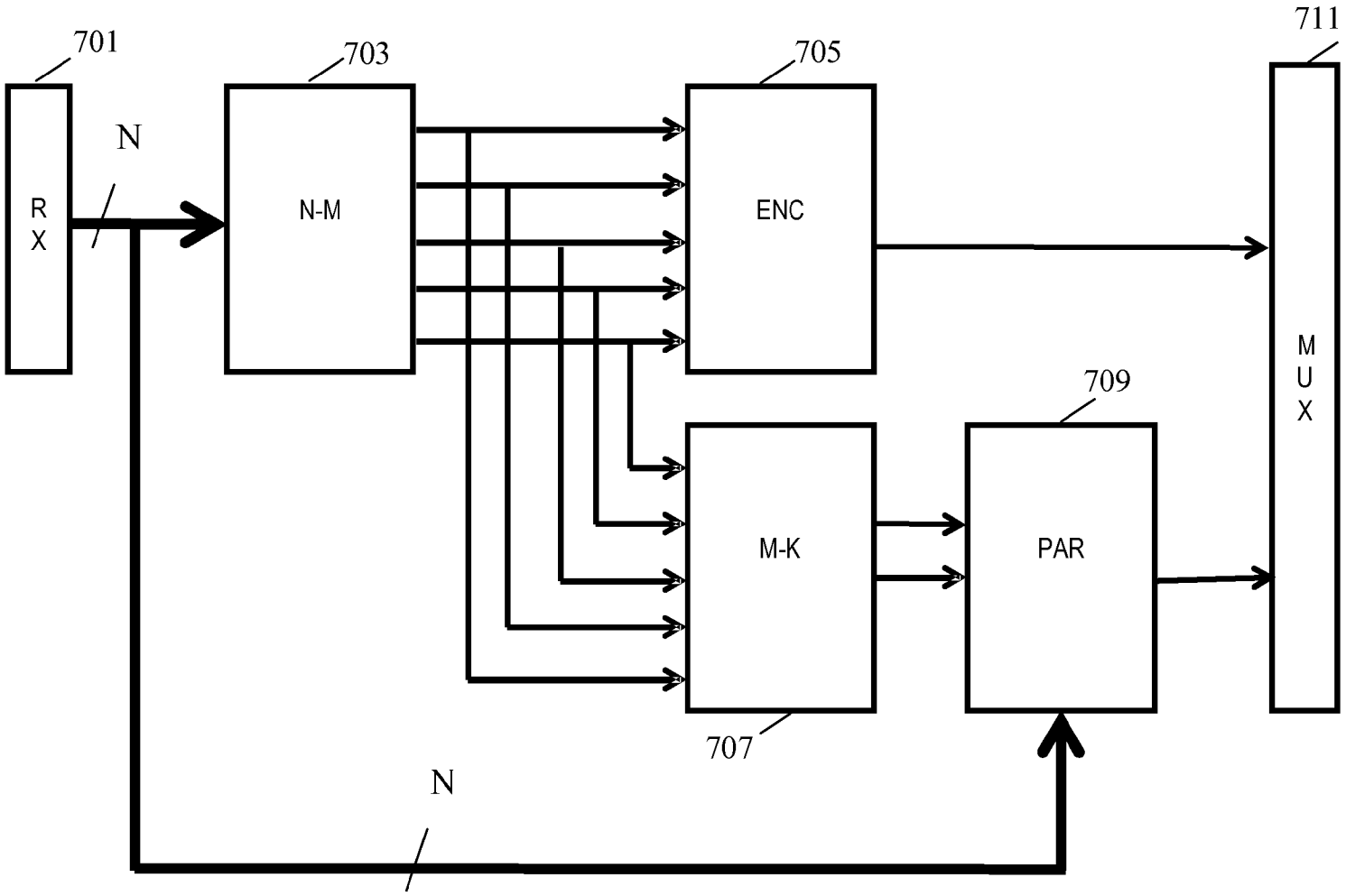
FIG. 7 illustrates an example of elements of an audio object encoder in accordance with some embodiments of the invention.

FIG. 7 illustrates elements of an audio object encoder in accordance with some embodiments of the invention.

The encoder comprises a receiver 701 which receives N audio objects. Each audio object typically corresponds to a single sound source. Thus, in contrast to audio channels, and in particular audio channels of a conventional spatial multichannel signal, the audio objects do not comprise components from a plurality of sound sources that may have substantially different positions. Similarly, each audio object provides a full representation of the sound source and. Each audio object is thus associated with spatial position data for only a single sound source. Specifically, each audio object may be considered a single and complete representation of a sound source and may be associated with a single spatial position.

Furthermore, the audio objects are not associated with any specific rendering configuration and are specifically not associated with any specific spatial configuration of sound transducers. Thus, in contrast to traditional spatial sound channels which are typically associated with a specific spatial speaker setup, such as in particular a surround sound setup, audio objects are not defined with respect to any specific spatial rendering configuration.

The N audio objects are fed to an N to M downmixer 703 which downmixes the N audio objects to M audio channels. In the example, M<N but it will be appreciated that in some scenarios N may be equal to or even smaller than M. In the specific example of FIG. 7, M equals 5 but it will be appreciated that in other embodiments other numbers of channels may be used, including for example M=7 or M=9.

Thus, the N to M downmixer 703 generates an M channel multichannel signal in which the audio objects are spread over the channels. In contrast to the N audio objects, the M audio channels are traditional audio channels which typically comprise data from a plurality of audio objects and thus a plurality of sound sources with different positions. Furthermore, the individual audio objects are generally spread over the M audio channels and often each of the M audio channels comprises a component from a given audio object, although in some scenarios some audio objects may only be represented in a subset of the M audio channels.

The N to M downmixer 703 generates a multichannel signal (henceforth used to denote the signal provided by the M audio channels) which may directly be rendered as a multichannel signal. Specifically, the multichannel signal formed by the M audio channels may be a spatial surround signal, and in the specific example the M audio channels may be respectively the front left, front right, centre, surround left and surround right channels of a five channel system (and accordingly M=5). Thus, the multichannel signal formed by the M audio channels is associated with a specific rendering configuration and specifically each audio channel is an audio channel associated with a rendering position.

The N to M downmixer 703 can perform the downmix such that the individual audio objects are positioned as desired in the surround image provided by the M audio channels. For example, one audio object can be positioned directly to the front, another object can be positioned to the left of the nominal listening position etc. The N to M downmix may specifically be manually controlled such that the resulting surround sound signal of the M audio channels provide the desired spatial distribution when the multichannel signal is rendered directly. The N to M downmix can specifically be based on an N to M downmix matrix that is manually generated by a person to provide the desired surround signal from the M audio channels.

The M audio channels are fed to an M channel encoder 705 which proceeds to encode the M audio channels in accordance with any suitable encoding algorithm. The M channel encoder 705 typically employs a conventional multichannel encoding scheme to provide an efficient representation of the corresponding surround signal.

It will be appreciated that the encoding of the M audio channels is typically preferred but is not necessary in all embodiments. For example, the N to M downmixer 703 may directly generate a frequency domain or time domain representation of the signals which can be used directly. For example, it is possible to send the M audio channels to an object decoder using un-encoded PCM data. However, an efficient encoding may substantially reduce the data rate and is therefore typically used.

The encoded multichannel signal may specifically correspond to a conventional multichannel signal and a conventional audio device receiving the multichannel signal can accordingly render the multichannel signal directly.

The encoder of FIG. 7 furthermore comprises functionality for providing audio object upmix parameters that allows the original N audio objects to be regenerated at a suitably equipped object decoding device. However, the audio object upmix parameters are not provided relative to the M audio channels but are instead provided relative to K audio channels where K is one or two. Thus, the encoder generates audio object upmix parameters relative to a mono or stereo signal. This allows compatibility with standards allowing only object encoding and decoding based on mono or stereo downmix signals from the original audio objects. This may in many scenarios allow standard audio object encoder or decoder functionality for mono or stereo signals to be reused with multichannel support. For example, the approach may be used to allow improved compatibility with SAOC.

The encoder comprises an M to K channel reducer 707 which receives the M audio channels from the N to M downmixer 703 and which then proceeds to derive K audio channels from the M audio channels with K being 1 or 2.

The M to K channel reducer 707 is coupled to a parameter circuit 709 which also receives the original N audio objects from the receiver. The M to K channel reducer 707 is arranged to generate audio object upmix parameters for at least part of each of the N audio objects relative to the K audio channels. Thus, audio object upmix parameters are generated which describe how (part or all of) the N audio objects can be generated from the mono or stereo signal received from the M to K channel reducer 707.

The M channel encoder 705 and the parameter circuit 709 are coupled to an output circuit 711 which generates an output data stream comprising the audio object upmix parameters received from the parameter circuit 709 and the encoded M audio channels received from the M channel encoder 705. However, the output data stream does not include any data of the K audio channels (whether encoded or not). Thus, an output data stream is generated which comprises an encoded multichannel signal that can be rendered directly by legacy multichannel devices even if no capable audio object decoding or processing. In addition, audio object upmix parameters are provided which can allow the original N audio objects to be regenerated at the decoder side. However, the audio object upmix parameters are not provided relative to the signal included in the data stream but instead relative to a stereo or mono signal which is not included in the output data stream. This allows the operation to be compatible with audio object encoding and decoding approaches that are limited to mono and stereo signals. For example, existing SAOC encoding or decoding units may be reused while allowing multichannel support.

Furthermore, although the K audio channels are not included in the output data stream, they can be derived from the multichannel signal by the decoder. Accordingly, a suitably equipped decoder may derive the K audio channels and then generate the N audio objects based on the audio object upmix parameters. This can specifically be done using existing upmix functionality based on an underlying stereo or mono signal. Thus the approach may allow a single output data stream to provide a multichannel signal which can be rendered directly by multichannel devices and audio object data related to a mono or stereo signal not included in the output data stream yet still allowing the original audio objects to be generated.

The output data stream may specifically comprise a multichannel encoded data stream for the M audio channels where the multichannel encoded data stream also includes the audio object upmix parameters. Thus, a multichannel encoded data stream may be provided which comprises the multichannel signal itself plus data for generating the individual audio objects comprised in the multichannel signal but where this data is not related to the multichannel signal itself but rather to a mono or stereo signal which is not included in the multichannel encoded data stream. The audio object upmix parameters may specifically be included in an ancillary, auxiliary or optional data field of the multichannel encoded data stream.

Figure 8:
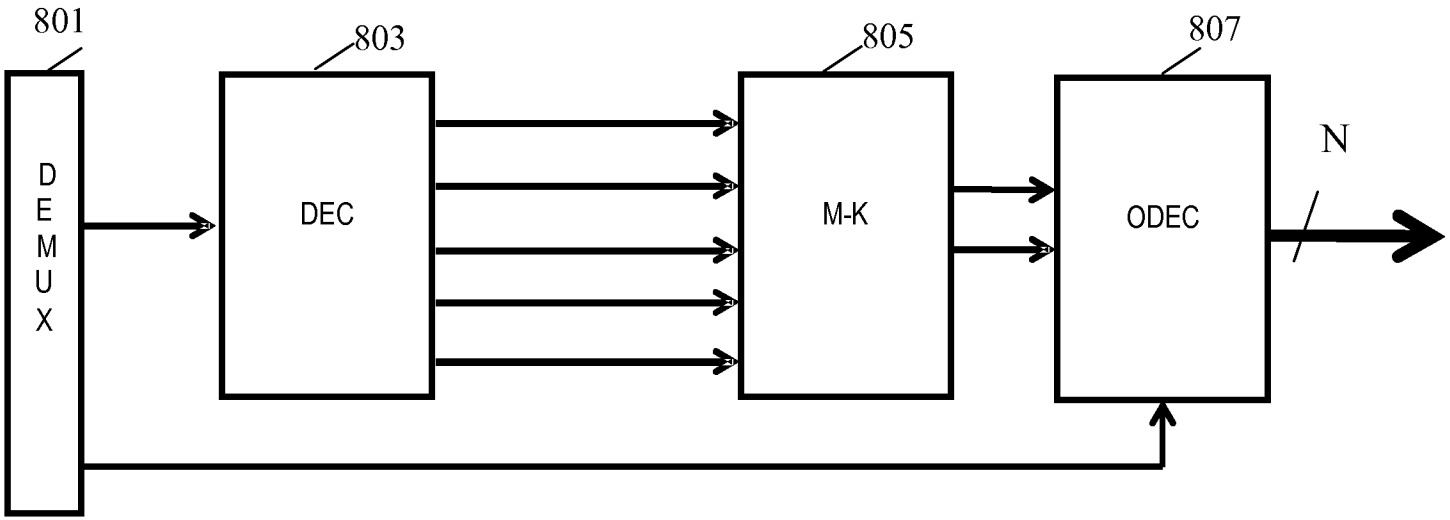
FIG. 8 illustrates an example of elements of an audio object decoder in accordance with some embodiments of the invention.

FIG. 8 illustrates an example of a decoder in accordance with some embodiments of the invention.

The decoder comprises a receiver 801 for receiving the output data stream from the encoder of FIG. 7. Thus, the receiver receives a data stream comprising audio data for an M channel downmix of N audio objects together with audio object upmix parameters for the N audio objects relative to K audio channels where K=1 or 2 and K<M. In the example the audio data for the M channel downmix is encoded audio data.

The encoded audio data for the M channel downmix is fed to a multichannel decoder 803 which generates the M audio channels from the encoded audio data. The M audio channels are fed to an M to K channel processor 805 which derives the K audio channels from the M audio channels. The M to K channel processor 805 specifically performs the same operation as the M to K channel reducer 707 of the encoder of FIG. 7. The resulting K audio channels are fed to an object decoder 807 which generates the N audio objects by upmixing the K audio channels based on the audio object upmix parameters. The object decoder 807 specifically performs the inverse operation of the parameter circuit 709 of FIG. 7.

It will be appreciated that in the example of FIG. 8, the object decoder 807 regenerates the N audio objects which can then be individually processed and/or mapped to a specific speaker configuration. Thus, in the example, P output signals are generated where P=N and each output signal corresponds to one of the N audio objects.

In some embodiments, the mapping to a given speaker configuration may be combined with the upmixing of the object decoder 807, e.g. by applying a single matrix multiplication where the matrix coefficients reflect the combined matrix multiplication of the mapping of the K audio channels to the N audio objects and the matrix multiplication of the mapping of the N audio objects to the channels of the speaker configuration.

Specifically, P audio signals may be generated where each of the P audio signals may correspond to a spatial output channel of a given P-channel rendering configuration. This may be achieved by the object decoder 807 applying a rendering matrix which maps the N audio objects to the P audio signals. Typically, the object upmix matrix generating the N audio objects from the K audio channels is combined with the rendering matrix mapping the N audio objects to the P audio signals. Thus, a single combined object upmix and rendering matrix is applied to the K audio channels to generate the P audio signals. The combined object upmix and rendering matrix can specifically be generated by multiplying the object upmix matrix and the rendering matrix.

In some embodiments, the M to K channel processor 805 and the M to K channel reducer 707 may be arranged to generate the K channels by downmixing the M audio channels. In particular, the downmix may be generated such that all the audio objects have significant signal components in the downmix thereby allowing the upmixing based on the K channels to be efficient for all N audio objects.

Figure 9:
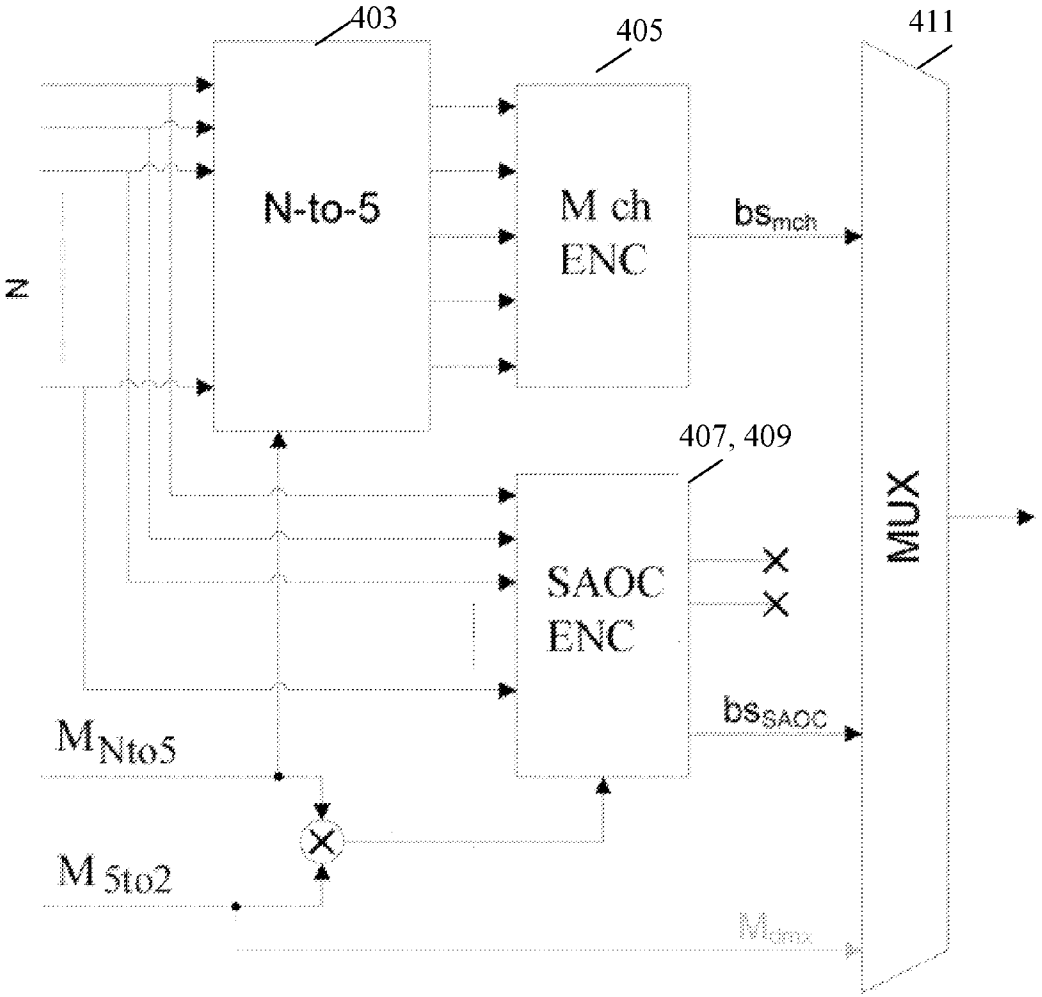
FIG. 9 illustrates an example of elements of an audio object encoder in accordance with some embodiments of the invention.

An example of this approach is illustrated in FIG. 9. In the specific example, the object encoding is compatible with the SAOC standard, and thus an SAOC encoder is specifically used. In the specific example M=5 and K=2.

Furthermore, it is noted that in the example of FIG. 9 the generation of the K audio channels is performed by combining the operation that generates the M audio channels from the N audio objects and the operation that generates the K audio channels from the M audio channels into a single operation.

Specifically, the M audio channels may be generated by applying an encoder rendering matrix $M_{Nto5}$ to the N audio objects to provide the M audio channels (a matrix multiplication may be performed for each frequency time tile as will be known to the person skilled in the art). Similarly, the K audio channels may be generated by applying a rendering matrix $M_{5to2}$ to the M audio channels to provide the K audio channels (a matrix multiplication may be performed for each frequency time tile as will be known to the person skilled in the art). The sequential operation of these two matrix operations may be replaced by a single matrix operation performing the combined operation. Specifically, a single matrix multiplication by a matrix $$M_{Nto2}=M_{5to2}\cdot M_{Nto5},$$

may be applied directly to the N audio objects as this is identical to applying the matrix $M_{5to2}$ to the M (in the specific example 5) audio channels generated by the N to M downmixer 703 by the application of the matrix $M_{Nto5}$. Thus, in the decoder, the K channels are simply generated by multiplying the M (i.e. in the specific example 5) audio channels and the downmix matrix $M_{5to2}$.

It will be appreciated that any suitable approach or method for selecting or determining the rendering matrix $M_{Nto5}$ may be used. Typically, a matrix is (semi)manually generated to provide the desired sound image.

Similarly, it will be appreciated that any suitable approach or method for selecting or determining the downmix matrix $M_{5to2}$ may be used. In some embodiments a fixed or predetermined downmix matrix $M_{5to2}$ may be used. This predetermined matrix may be known at the decoder which can accordingly apply it to the M audio channels to generate the stereo signal required for the audio object generation.

In other embodiments, the downmix matrix $M_{5to2}$ may be a variable matrix which is adapted or optimized in the encoder dependent on the specific characteristics. For example, the downmix matrix $M_{5to2}$ may be determined such that it is ensured that all audio objects are represented in a desirable way in the resulting stereo signal. In such embodiments, information on the downmix matrix $M_{5to2}$ used at the encoder may be included in the output data stream. The decoder may then extract the downmix matrix $M_{5to2}$ and apply this to the decoded M audio channels thereby generating the K audio channels to which the SAOC parameters can be applied.

Figure 10:
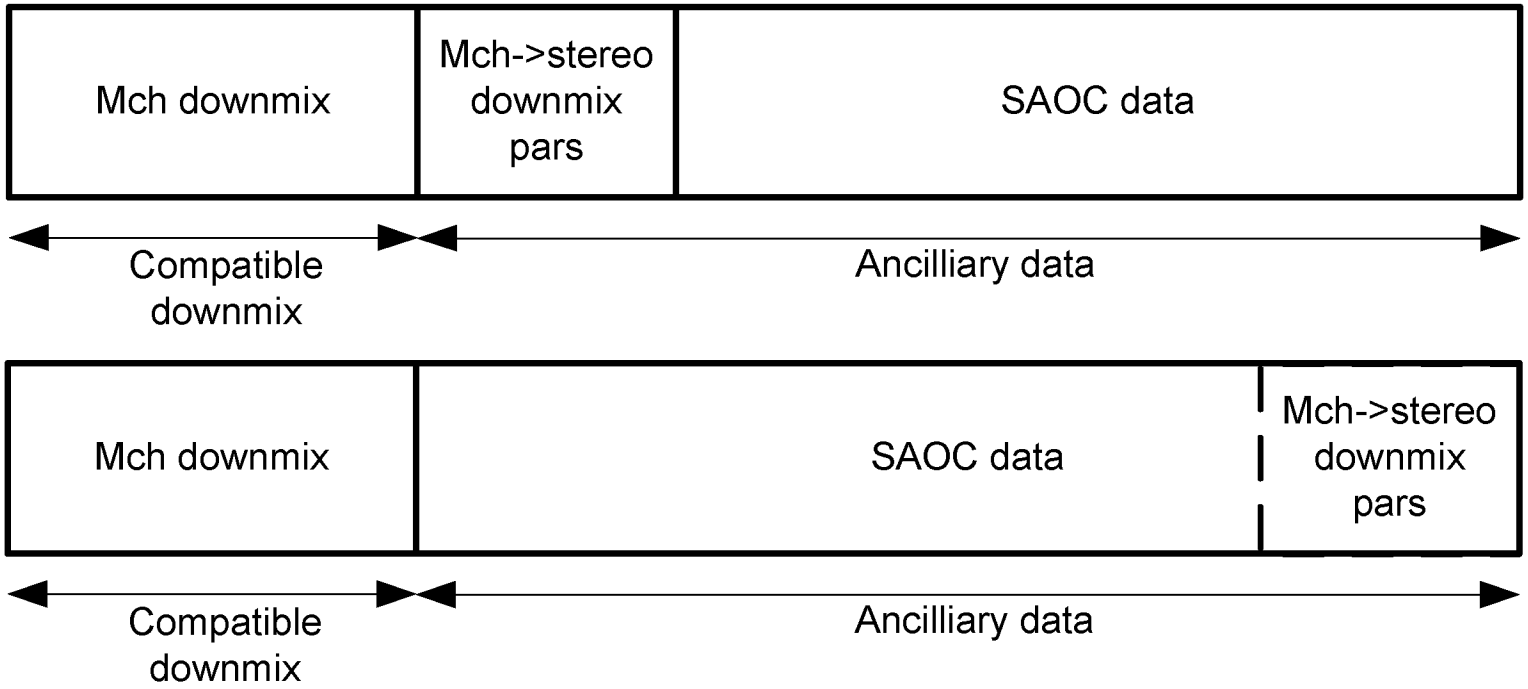
FIG. 10 illustrates an example of an encoder output data stream in accordance with some embodiments of the invention.

When allowing an adaptive multichannel to stereo downmix, the data can be transmitted by employing the ancillary data structure in the syntax of the multichannel bitstream, e.g. similarly to the transmission of the SAOC data. This is illustrated in FIG. 10 which shows two different two options:

- the downmix parameters being transmitted in a separate container prior (or after) the SAOC container; and
- the downmix parameters being transmitted inside the SAOC container as a new entry in the SAOCExtensionConfig( ) field.

In some embodiments, the derivation of the K channels from the M audio channels is performed by selecting a subset of M audio channels.

For example, the SAOC encoding may be performed in response to only two audio channels, such as the front left and front right channels of a five channel surround signal formed by the M audio channels.

However, in many scenarios such an approach may lead to suboptimally decoded objects due to the selected subset channels potentially not including any signal components from a given audio object (in contrast to downmixed channels wherein the M audio channels can be downmixed to the K audio channels such that contributions from all M audio channels, and thus from all N audio objects, are included in the downmixed K channels).

Such problems may possibly be addressed by the decoder generating part or all of some of the N audio objects using other parallel approaches. For example, using the SAOC send effects interface functionality defining send effects to introduce a contribution generated as a send effect. The send effect may be defined such that it can provide a contribution to audio objects which cannot be generated with sufficient quality from the selected K audio channels.

In some embodiments, contributions from the audio objects may be generated from a plurality of subsets of the M audio channels, where each subset is provided with suitable audio object upmix parameters. In some embodiments, each audio object may be generated from a single subset of the M audio channels with different audio objects being generated from different subsets depending on how the objects have been downmixed to the M audio channels. However, typically the N objects will be distributed over more than K channels of the M audio channels and therefore the audio objects may be generated by combining contributions from upmixing of the different subsets of the M audio channels.

The encoder may thus have parallel parameter estimators which are fed different subsets of the N audio objects. Alternatively, all N objects are fed to each of the parallel parameter estimators. Rendering matrix $M_{Nto5}$ is split such, and used as a downmix matrix in each parameter estimator, that the signal outputs of the parameter estimators constitute the M channel mix. For example, one parameter estimator may produce K audio channels of the M audio channels and another parameter estimator may produce L audio channels of the M audio channels. E.g. one parameter estimator generates the front left and right channels and another estimator is generates the center channel. The parameter estimators additionally generate audio object upmix parameters for the respective channels. The audio object upmix parameters for each individual parameter estimator is included in the output data stream as a separate set of audio object upmix parameters, e.g. specifically as a separate SAOC parameter data stream.

Thus, the encoder may generate a plurality of parallel SAOC compatible data streams each of which is associated with a stereo or mono subset of the M audio channels. The corresponding decoder may then decode each of these SAOC compatible data streams individually using a standard SAOC decoder setup. The resulting decoded audio object components are then combined into the complete audio objects (or directly into output channels corresponding to the desired output speaker configuration). The approach may thus allow that all the signal components in the M audio channels can be exploited when generating the individual audio object. Specifically, the subsets may be selected such that they together contain all of the M audio channels with each audio channel only being included in a single subset. Thus, the subsets may be disjoint and include all the M audio channels.

As a specific example, multiple SAOC streams can be included/transmitted with the M audio channel downmix, such that each stream operates on a mono or stereo subset of the multichannel downmix. With the objects possibly present in either specific, or in multiple streams, the rendering matrix used at the decoder side to distribute the audio objects to the desired output (speaker) configuration can be adapted to combine the individual contributions to the individual audio objects. The approach can provide a particularly high reconstruction quality.

In comparison to the embodiment of FIG. 9, the N-to-5 matrix is in such a specific example not combined with a 5-to-2 downmix matrix to provide a K channel downmix of the five audio channels. Rather, the N-to-5 matrix is dissected and sent to three parallel SAOC encoders of which the bitstreams are all multiplexed into the bitstream. For example $$M_{dmx} = \begin{pmatrix} m_{11} & m_{12} & \dots & m_{1N} \\ m_{21} & \ddots & & \vdots \\ \vdots & & \ddots & \vdots \\ m_{51} & \dots & \dots & m_{5N} \end{pmatrix},$$

can be divided into $$M_{dmx,1} = \begin{pmatrix} m_{11} & m_{12} & \dots & m_{1N} \\ m_{21} & m_{22} & \dots & m_{2N} \end{pmatrix},$$

$$M_{dmx,2} = \begin{pmatrix} m_{31} & m_{32} & \dots & m_{3N} \end{pmatrix},$$

$$M_{dmx,3} = \begin{pmatrix} m_{41} & m_{42} & \dots & m_{4N} \\ m_{51} & m_{52} & \dots & m_{5N} \end{pmatrix},$$

to provide three parallel SAOC streams that would typically work well for a typical five channel ordering of $\{L_f, R_f, C, L_s, R_s\}$ where L denotes left, R denotes right, C denotes centre, subscript f denotes front, and subscript s denotes surround.

Figure 11:
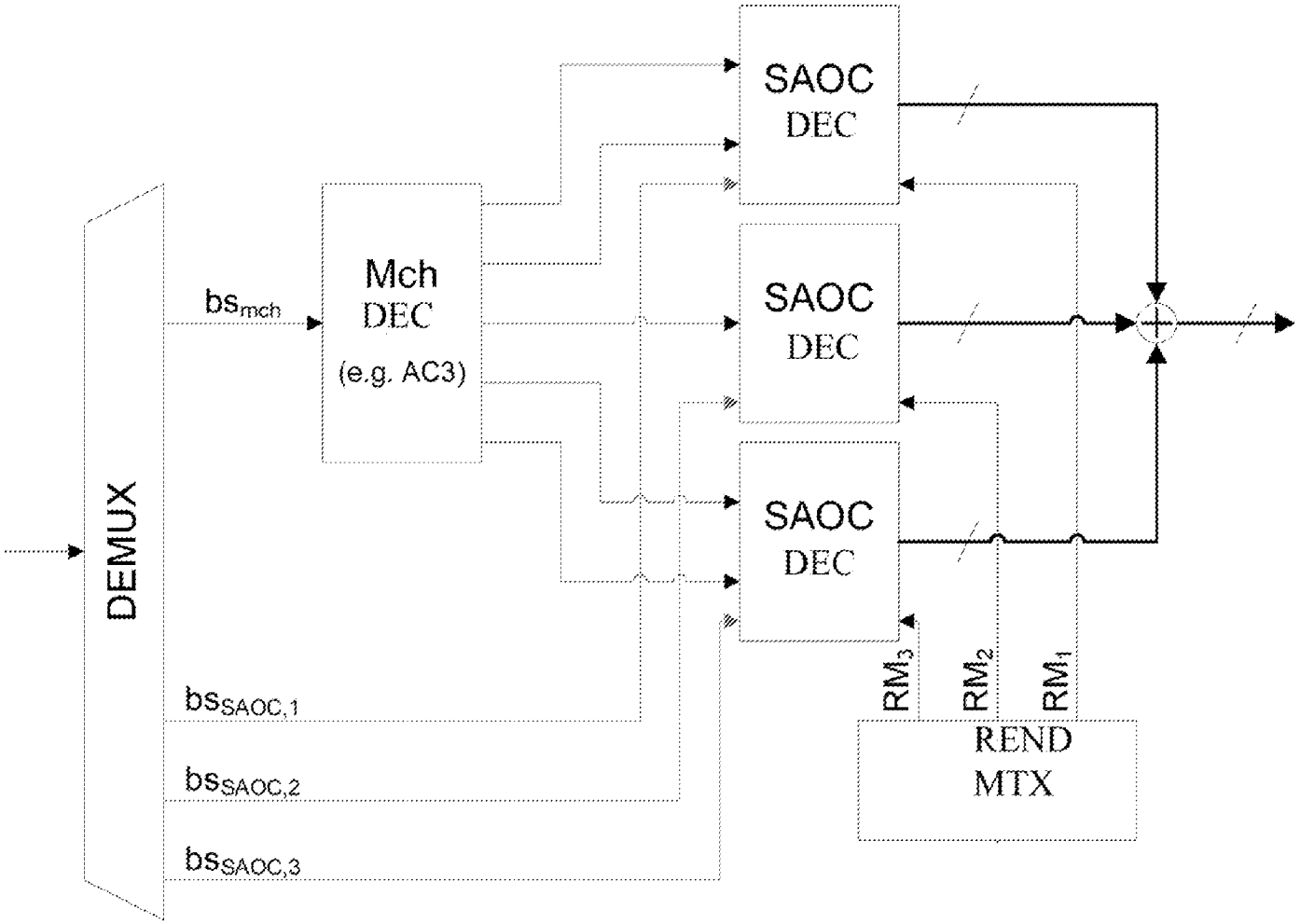
FIG. 11 illustrates an example of elements of an audio object decoder in accordance with some embodiments of the invention.

FIG. 11 shows an example of a decoder for such an approach.

In some embodiments, the encoder may further be arranged to include downmix data representative of the downmixing of the N audio objects to the M audio channels into the output data stream. For example, the encoder rendering matrix describing the downmix of the N audio objects to the M audio channels may be included in the output data stream (i.e. in the specific example of FIG. 9, the matrix $M_{Nto5}$ may be included.

The additional information may be used in different ways in different embodiments.

Specifically, in some embodiments the downmix data may be used to generate a subset of the audio objects based on the M audio channels. As there is more information available in the M audio channels than in the K audio channels, this may allow improved quality audio objects to be generated. However, the processing may not be compatible with a corresponding audio object encoding/decoding standard and may thus require additional functionality. Furthermore, the computational requirements will typically be higher than for a standard (and typically heavily optimized) object decoding based on K signals. Therefore, the audio decoding based on the M audio channels and the downmix data may be limited to only a subset of the audio objects, and typically only to a very small number of the most dominant audio objects. The remaining audio objects may be generated using a standardised decoder based on the K channels. This decoding may often be substantially more efficient, e.g. by using dedicated and standardised hardware.

Furthermore, some encoding standards, such as SAOC, is capable of receiving residual data from the encoder where the encoded data reflects the difference between the original audio object and that which will be generated by a decoder based on the downmix and the audio object upmix parameters. Specifically, SAOC supports a feature known as Enhanced Audio Objects (EAO) which allows residual data to be provided for up to four audio objects.

In some embodiments the downmix data representative of the downmixing of the N audio objects to the M audio channels can be used to generate residual data at the decoder. Specifically, the decoder can calculate a specific audio object based on the downmix data, the M audio channels and the audio object upmix parameters. In addition, the same object can be decoded based on the K audio channels and the audio object upmix parameters. Residual data can be generated as an indication of the a difference between these. This residual data can then be used in the decoding of the N audio objects. This decoding may use a standardised approach for an object decoding standard which is based on K channels and which allows for residual data to be provided from the encoder.

In such an approach the additional information provided by the downmix data and the M audio channels is thus used to generate residual data information at the decoder rather than at the encoder. Thus, no residual data needs to be communicated. It will be appreciated that the object generated from the downmix data and the M audio channels may not be identical to the corresponding audio object before encoding but the additional information will typically still provide an improvement over the corresponding audio object generated from the K audio channels.

Figure 12:
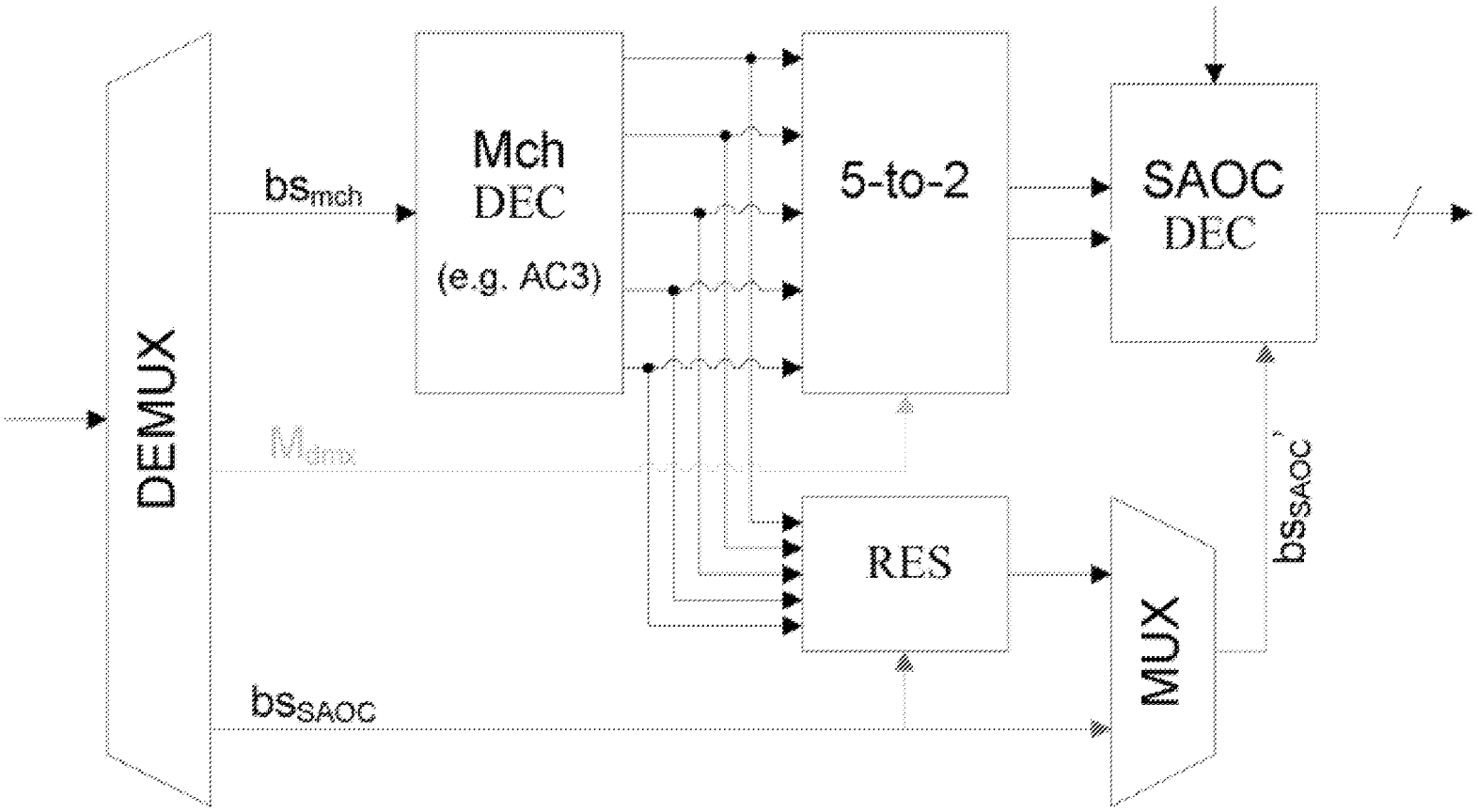
FIG. 12 illustrates an example of elements of an audio object decoder in accordance with some embodiments of the invention.

As a specific example, a standard SAOC decoder may be provided with a pre-processor which generates residual data that is fed to the SAOC decoder as if it were residual data generated at the encoder. Thus, the SAOC decoder may operate fully in accordance with the SAOC standard regarding EAO. In example of such a decoder is illustrated in FIG. 12.

The pre-processor may specifically calculate an audio object using the $M_{Nto5}$ matrix. For example, an audio object may be generated from the 5 channel downmix using the following equation:

$$\sqrt{\frac{M_{Nto5,1k}^2 \cdot OLD_k}{\sum_{i=1}^{N} M_{Nto5,1i}^2 \cdot OLD_i}} \cdot X_1$$

which reconstructs object k from downmix channel $X_1$, where OLD is the linear representation of the OLD (Object Level Difference) parameter in the SAOC bitstream. This equation may be applied to each time-frequency tile of $X_1$, using the corresponding SAOC parameters.

The above reconstruction assumes uncorrelated objects. By including the SAOC IOC parameters, it is possible to take inter-object correlations into account, e.g. by using the equation:

$$\sqrt{\frac{M_{Nto5,1k}^2 \cdot OLD_k}{\sum_{i=1}^{N}\sum_{j=1}^{N} M_{Nto5,1i} \cdot M_{Nto5,1j} \cdot \sqrt{OLD_i \cdot OLD_j} \cdot IOC_{ij}}} \cdot X_1$$

This reconstruction is weighed with the gain of object k in downmix channel 1 ($M_{Nto5,1k}$).

Combining similar reconstructions from all 5 channels gives an object reconstruction that is weighed according to the gains to object k, i.e. the channel in which object k has the largest gain provides the largest contribution to the combined reconstruction $\tilde{S}_k$ of object k:

$$\tilde{S}_k = \frac{\sum_{c=1}^{5} \sqrt{\frac{M_{Nto5,ck}^2 \cdot OLD_k}{\sum_{i=1}^{N}\sum_{j=1}^{N} M_{Nto5,ci} \cdot M_{Nto5,cj} \cdot \sqrt{OLD_i \cdot OLD_j} \cdot IOC_{ij}}} \cdot X_c}{\sum_{c=1}^{5} M_{Nto5,ck}}$$

where $$\sum_{c=1}^{5} M_{Nto5,ck}$$

normalizes the reconstruction to the correct level.

As another example, an alternative weighed reconstruction could aim at 'isolatedness' of an object in a downmix channel.

Define:

$$B_{ck} = \sqrt{\frac{M_{Nto5,ck}^2 \cdot OLD_k}{\sum_{i=1}^{N}\sum_{j=1}^{N} M_{Nto5,ci} \cdot M_{Nto5,cj} \cdot \sqrt{OLD_i \cdot OLD_j} \cdot IOC_{ij}}},$$

then the alternative reconstruction $$\tilde{S}_k = \frac{\sum_{c=1}^{5} B_{ck}^2 \cdot \frac{B_{ck} \cdot X_c}{M_{Nto5,ck}}}{\sum_{c=1}^{5} B_{ck}^2},$$

weighs each normalized sub-reconstruction ($B_{ck} \cdot X_c$) of object k with its relative contribution to the corresponding downmix channel.

It will be appreciated that other approaches for generating the audio object from the M audio channels and the N to M downmix can be used in other embodiments.

In an SAOC encoder where Enhanced Audio Objects (EAO) are encoded, the corresponding residual signals are calculated as a difference between the original object signal and a reconstruction based on the mono or stereo SAOC downmix. These enhanced objects ($X_{eao}$) are therefore processed separately from the regular objects ($X_{reg}$).

The regular objects are downmixed according to a submatrix ($D_{reg}$) of the K×N downmix matrix (D), where $$D = (D_{reg} \quad D_{eao})$$

when $$X = \begin{pmatrix} X_{reg} \\ X_{eao} \end{pmatrix}.$$

The result is a K-channel downmix:

$$Y_{reg} = D_{reg} \cdot X_{reg}$$

The EAOs are also downmixed using the corresponding submatrix $D_{eao}$, and the resulting downmix is combined with the downmix of the regular objects ($Y_{reg}$) into the SAOC downmix.

$$Y = Y_{reg} + D_{eao} \cdot X_{eao}$$

This downmix is expected at the input of the SAOC decoder.

Using downmix $Y_{reg}$ and the EAOs as input signals, intermediate auxiliary signals are calculated using the $N_{eao} \times (K+N_{eao})$ matrix $D_{aux}$, where $N_{eao} = N - N_{reg}$ the number of EAOs.

$$Y_{aux} = D_{aux} \cdot \begin{pmatrix} Y_{reg} \\ X_{eao} \end{pmatrix}$$

The generation of the downmix Y and auxiliary signals $Y_{aux}$ can be combined in a single matrix equation:

$$Y_{ext} = \begin{pmatrix} Y \\ Y_{aux} \end{pmatrix} = D_{ext} \cdot \begin{pmatrix} Y_{reg} \\ X_{eao} \end{pmatrix}$$

where $$D_{ext} = \left(\begin{array}{cc|c} 1 & 0 & \\ 0 & 1 & D_{eao} \\ \hline \multicolumn{3}{c}{D_{aux}} \end{array}\right).$$

Matrix $D_{aux}$ is chosen such that matrix $D_{ext}$ is invertible and the EAO separation from the downmix is optimized. The elements of $D_{aux}$ are defined in the SAOC standard and thus available in the decoder. In the SAOC decoder, using the inverse of $D_{ext}$, the EAOs ($X_{eao}$) can be separated from the regular objects ($Y_{reg}$) using the downmix (Y) and auxiliary signals ($Y_{aux}$) as an input.

In order to improve coding efficiency, the auxiliary signals are predicted from the downmix signals with prediction coefficients that are derived from data already available in the decoder.

$$\hat{Y}_{aux}=C\cdot Y$$

The prediction error $R=Y_{aux}-\hat{Y}_{aux}$ can be efficiently coded using the residual coding mechanism of the SAOC standard.

The residuals of this embodiment can be generated in the same way as described above using the M-channel object reconstruction $\tilde{S}$ as the EAOs ($=X_{eao}$). Since the individual objects are already mixed, these steps can be omitted. Thus giving $$Y_{ext}=D'_{ext}\cdot\begin{pmatrix} Y \\ \tilde{S} \end{pmatrix},$$

with $$D'_{ext}=\left(\begin{array}{cc|c} 1 & 0 & 0 \\ 0 & 1 & \\ \hline \multicolumn{3}{c}{D_{aux}} \end{array}\right),$$

and $$Y'_{ext}=\begin{pmatrix} Y \\ Y'_{aux} \end{pmatrix}.$$

In case of four EAOs:

$$D'_{ext}=\left(\begin{array}{cccccc} 1 & 0 & 0 & 0 & 0 & 0 \\ 0 & 1 & 0 & 0 & 0 & 0 \\ \hline d_{ext,31} & d_{ext,32} & d_{ext,33} & \cdots & \cdots & d_{ext,61} \\ \vdots & & & \ddots & & \vdots \\ \vdots & & & & \ddots & \vdots \\ d_{ext,61} & \cdots & \cdots & \cdots & \cdots & d_{ext,66} \end{array}\right).$$

The residuals are then calculated as $$R'=Y_{aux}'-\hat{Y}_{aux}',$$

with $$\begin{pmatrix} Y \\ \hat{Y}'_{aux} \end{pmatrix}=C\cdot Y.$$

The resulting residuals (R') can then be inserted in the SAOC bitstream, in which the objects for which the residuals are calculated are identified as EAOs. The standard SAOC decoder can then proceed to perform a standard SAOC EAO decoding to generate the N audio channels.

This may provide improved quality of the decoded audio objects in many embodiments. In many embodiments it may allow compatibility with standardized audio object decoding algorithms capable of receiving residual data, such as for example the SAOC standard. The residual data may specifically be indicative of a difference between an audio object generated from the K channels and the audio object upmix parameters and the corresponding audio object generated on the basis of the M audio channels and the downmix data.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio object encoder comprising:

a receiver configured to receive N audio objects;

a mixer configured to mix the N audio objects to produce M first audio channels;

a channel circuit configured to derive K second audio channels from the M first audio channels where K=1 or 2 and K<M, wherein each of the M first audio channels is represented in at least one of the K second audio channels;

a parameter circuit configured to generate audio object upmix parameters for at least part of each of the N audio objects relative to the K second audio channels, the upmix parameters describing how the N audio objects may be generated from the K second audio channels; and an output circuit configured to generate an output data stream comprising the audio object upmix parameters and the M first audio channels, wherein the output data stream does not include any of the K second audio channels.

2. The audio object encoder of claim 1 wherein the channel circuit is configured to derive the K second audio channels by downmixing the M first audio channels.

3. The audio object encoder of claim 1 wherein the channel circuit is configured to derive the K second audio channels by selecting a K second audio channel subset of the M first audio channels.

4. The audio object encoder of claim 1 wherein the output data stream comprises a multichannel encoded data stream for the M first audio channels, and the audio object upmix parameters are comprised in a part of the multichannel encoded data stream.

5. The audio object encoder of claim 1 wherein the output circuit is configured to include mixing data representative of the mixing of the N audio objects to the M first audio channels in the output data stream.

6. An audio object decoder comprising:

a receiver receiving a data stream comprising audio data for an M first audio channel mix of N audio objects and audio object mix parameters for the N audio objects relative to K second audio channels where K=1 or 2 and K<M, wherein each of the M audio channels is presented in at least one of the K audio channels and the output data stream does not include any of the K audio channels;

a channel circuit deriving K second audio channels from the M channel mix; and an object decoder generating P audio signals from N audio objects at least partially generated by upmixing the K second audio channels based on the audio object upmix parameters.

7. The audio object decoder of claim 6 wherein the channel circuit is configured to derive the K second audio channels by downmixing the M first audio channels.

8. The audio object decoder of claim 7 wherein the data stream comprises downmix data indicative of an encoder downmixing from M first audio channels to K second audio channels, and wherein the channel circuit is configured to adapt the downmixing in response to the downmix data.

9. The audio object decoder of claim 7 wherein the channel circuit is configured to derive the K second audio channels by selecting a K second audio channel subset of the M first audio channels.

10. The audio object decoder of claim 9 wherein the data stream comprises additional audio object upmix parameters for the N audio objects relative to L third audio channels where L=1 or 2 and L<M, and the L third audio channels and the K second audio channels are different subsets of the M first audio channels, and wherein the object decoder is further configured to generate the P signals from N audio objects at least partially generated by upmixing the L third audio channels based on the additional audio object upmix parameters.

11. The audio object decoder of claim 10 wherein at least one of the P signals is generated by combining contributions from both the upmixing of the K second audio channels based on the audio object upmix parameters and the upmixing of the L third audio channels based on the additional audio object upmix parameters.

12. The audio object decoder of claim 6 wherein the data stream comprises mix data representative of the mixing of the N audio objects to the M first audio channels, and wherein the object decoder is arranged to generate residual data for at least a subset of the N audio objects in response to the mix data and the audio object upmix parameters, and to generate the P audio signals in response to the residual data.

13. A method of operating an audio object encoder comprising:

in an audio object encoder:

receiving in a receiver, N audio objects;

mixing in a mixer the N audio objects to produce M first audio channels;

deriving in a channel circuit, K second audio channels from the M first audio channels where K=1 or 2 and K<M, wherein each of the M first audio channels is represented in at least one of the K second audio channels;

generating in parameter circuit audio object upmix parameters for at least part of each of the N audio objects relative to the K second audio channels, the upmix parameters describing how the N audio objects may be generated from the K audio channels; and generating via an output circuit, an output data stream comprising the audio object upmix parameters and the M audio channels, wherein the output data stream does not include any of the K audio channels.

14. A computer program product, stored on a medium that is not a transitory propagating wave or signal, the program product comprising computer program code, which when accessed by an audio object encoder causes the encoder to execute the acts of claim 13.

15. A method of operating an audio object decoder comprising:

in an audio object encoder:

receiving into a receiver, a data stream comprising audio data for an M first channel mix of N audio objects and audio object upmix parameters for the N audio objects relative to K second audio channels where K=1 or 2 and K<M, wherein each of the M first audio channels is presented in at least one of the K second audio channels and the output data stream does not include any of the K second audio channels;

deriving in a channel circuit, K second audio channels from the M first channel mix; and generating in an object decoder, P audio signals from the N audio objects, the P audio signals at least partially generated by upmixing the K second audio channels based on the audio object upmix parameters.

16. A computer program product, stored on a medium that is not a transitory propagating wave or signal, the program product comprising computer program code, which when accessed by an audio object decoder causes the decoder to execute the acts of claim 15.

* * * * *